US006645095B1

(12) United States Patent
Nye et al.

(10) Patent No.: US 6,645,095 B1
(45) **Date of Patent: *Nov. 11, 2003**

(54) SLIDE COLLAR ADJUSTMENT MECHANISM FOR A BASKETBALL GOAL ASSEMBLY

(75) Inventors: S. Curtis Nye, South Ogden, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/054,412

(22) Filed: Jan. 22, 2002

Related U.S. Application Data

(63) Continuation-in-part of application No. 09/929,984, filed on Aug. 14, 2001, which is a continuation-in-part of application No. 09/599,159, filed on Jun. 21, 2000, and a continuation-in-part of application No. 09/236,817, filed on Jan. 25, 1999, now Pat. No. 6,120,396, which is a continuation-in-part of application No. 09/018,231, filed on Feb. 3, 1998, now Pat. No. 6,077,177, which is a continuation-in-part of application No. 08/986,382, filed on Dec. 8, 1997, now Pat. No. 5,879,247, which is a continuation of application No. 08/799,979, filed on Feb. 12, 1997, now Pat. No. 5,695,417.

(60) Provisional application No. 60/263,029, filed on Jan. 19, 2001, and provisional application No. 60/140,509, filed on Jun. 22, 1999.

(51) Int. Cl.[7] ..... A63B 63/08

(52) U.S. Cl. ..... 473/484; 473/483; 473/482; 473/481; 248/274.1; 248/295.11; 248/297.11

(58) Field of Search ..... 473/481, 482, 473/483, 484, 471; 248/274.1, 280.11, 281.11, 283.1, 295.11, 297.11

(56) References Cited

U.S. PATENT DOCUMENTS 276,637 A 5/1883 Slater
1,924,811 A 8/1933 Schulz
2,932,511 A 4/1960 Bemis (List continued on next page.)

FOREIGN PATENT DOCUMENTS

NL 28616 2/1965

OTHER PUBLICATIONS

"Introducing New Huffy Elevator," Informational Brochure, Huffy Sports, Waukesha, Wisconsin (date unknown).
"Adjustable Backstop Support, Backboard and Goal Kit," Informational Brochure, Wilson, Franklin Park, illinois (date unknown).
"All–in–One "Quick Adjust "Kits", Informational Brochure, Porter (date unknown).

(List continued on next page.)

*Primary Examiner*—Raleigh W. Chiu
(74) *Attorney, Agent, or Firm*—Workman Nydegger

(57) ABSTRACT

The present invention relates to a basketball goal assembly with a basketball goal supported over a playing surface by a deformable goal support structure connected to a support pole. The deformable goal support structure may be connected to an adjustment collar configured to selectively slide over a series of holes arrayed along a portion of the length of the support pole. The adjustment collar may have a handle and a trigger, through which a user can retract an extension within the collar from a hole. The user can then slide the adjustment collar along the support pole until the extension is aligned over the desired hole and release the trigger, so that the adjustment collar locks in place, thereby locking the basketball goal at the desired height. The adjustment collar may be connected to the goal support structure by an adjustment arm pivotally attached to the goal support structure and the adjustment collar. The adjustment arm may be retained by the trigger, or by a housing of the adjustment collar. Through the present invention, a user may easily and safely adjust the height of the basketball goal with a single hand.

38 Claims, 3 Drawing Sheets

U.S. PATENT DOCUMENTS

| | | | |
|---|---|---|---|
| 3,427,025 | A | 2/1969 | Procter |
| 3,586,324 | A | 6/1971 | Bearson |
| 3,765,676 | A | 10/1973 | Bearson et al. |
| 3,802,702 | A | 4/1974 | Pulley |
| 4,395,040 | A | 7/1983 | White |
| 4,438,923 | A | 3/1984 | Engle et al. |
| 4,441,709 | A | 4/1984 | Schroeder et al. |
| 4,684,129 | A | 8/1987 | Andersen et al. |
| 4,738,487 | A | 4/1988 | Shalinsky et al. |
| 4,781,375 | A | 11/1988 | Nye |
| 4,798,381 | A | 1/1989 | Dadbeh |
| 4,801,142 | A | 1/1989 | Friesen |
| 4,805,904 | A | 2/1989 | Nye |
| 4,846,469 | A | 7/1989 | Nye |
| 4,881,734 | A | 11/1989 | Nye |
| 5,133,547 | A | 7/1992 | Pardi |
| 5,158,281 | A | 10/1992 | Williams |
| 5,259,612 | A | 11/1993 | Matherne et al. |
| D350,797 | S | 9/1994 | Curtis |
| 5,375,835 | A | 12/1994 | Van Nimwegen et al. |
| 5,388,821 | A | 2/1995 | Blackburn |
| 5,465,957 | A | 11/1995 | Schroeder |
| 5,478,068 | A | 12/1995 | Schroeder |
| 5,503,390 | A | 4/1996 | Hall |
| 5,570,880 | A | 11/1996 | Nordgran |
| 5,573,237 | A | 11/1996 | Van Nimwegen et al. |
| 5,573,238 | A | 11/1996 | Aaron et al. |
| 5,601,284 | A | 2/1997 | Blackwell et al. |
| 5,695,417 | A | 12/1997 | Winter et al. |
| 5,720,679 | A | 2/1998 | Schroeder |
| 5,738,601 | A | 4/1998 | Hughes |
| 5,879,247 | A | 3/1999 | Winter et al. |
| 5,947,847 | A | 9/1999 | Van Nimwegen et al. |
| 6,077,177 | A | 6/2000 | Winter et al. |
| 6,120,396 | A | 9/2000 | Van Nimwegen et al. |
| 6,135,901 | A | 10/2000 | Van Nimwegen |
| 6,142,891 | A | 11/2000 | Winter et al. |
| 6,155,938 | A | 12/2000 | Mower |
| 6,179,733 | B1 | 1/2001 | Story |
| 6,273,834 | B1 | 8/2001 | Winter |
| 6,283,878 | B1 | 9/2001 | White |
| 6,419,598 | B1 * | 7/2002 | Winter et al. ..... 473/484 |
| 6,422,957 | B1 * | 7/2002 | Winter et al. ..... 473/484 |

OTHER PUBLICATIONS

"Component Play Grounds", Equipment Brochure, Salt Lake City, Utah, p. 6 (date unknown).

Diversified Products, "DP Fit for Life," 1990 Equipment Catalog, Opelika, Alabama, p. 61.

Owner's Manual for Escalade Sports Portable Counter Balance Basketball System, 10 pages.

Huffy Sports Catalog, "Basketball's Hottest Products this Year," Equipment Catalog, Waukesha, Wisconsin (date unknown).

Huffy Sports, Equipment Catalog, Waukesha, Wisconsin, p. 21 (date unknown).

Diversified Products, "25 Years of Innovation," Opelika, Alabama, p. 69 (date unknown).

Huffy Sports, "Our All–Star Lineup," Waukesha, Wisconsin, p. 21 (date unknown).

Harvard, "1988 Sporting Goods Catalog," p. 8.

Harvard, Adjustable Basketball Pole with "Pro Style Breakaway Goal", owner's manul, 9 pages.

Huffy Sports, Equipment Assembly Instruction Sheet, Waukesha, Wisconsin (date unknown).

* cited by examiner

SLIDE COLLAR ADJUSTMENT MECHANISM FOR A BASKETBALL GOAL ASSEMBLY

RELATED APPLICATIONS

This application claims the benefit of U.S. Provisional Application No. 60/263,029 filed Jan. 19, 2001 and entitled SLIDE COLLAR ADJUSTMENT MECHANISM FOR A BASKETBALL GOAL ASSEMBLY. Additionally, this application is a continuation-in-part of application Ser. No. 09/929,984, filed Aug. 14, 2001 entitled QUICK-RELEASE SELF-ADJUSTING SLIDE COLLAR MECHANISM FOR HEIGHT ADJUSTMENT OF A BASKETBALL APPARATUS, which is a continuation-in-part of application Ser. No. 09/599/159 filed Jun. 21, 2000 entitled QUICK-RELEASE SELF-ADJUSTING LATCH FOR ADJUSTABLE BASKETBALL GOAL ASSEMBLY, which claims benefit of U.S. Provisional Application No. 60/140,509 filed Jun. 22, 1999, and is a continuation-in-part of application Ser. No. 09/236,817, filed Jan. 25, 1999, and entitled QUICK-RELEASE LOCKING MECHANISM FOR ADJUSTABLE BASKETBALL GOAL SYSTEM AND METHODS FOR USING SAME, now issued as U.S. Pat. No. 6,120,396 which is a continuation-in-part of application Ser. No. 09/018,231, filed Feb. 3, 1998, and entitled ADJUSTABLE BASKETBALL GOAL SYSTEM, now issued as U.S. Pat. No. 6,077,177, which is a continuation-in-part of application Ser. No. 08/986,382, filed Dec. 8, 1997, and entitled POWER LIFT BASKETBALL ADJUSTMENT SYSTEM, now issued as U.S. Pat. No. 5,879,247, which is a continuation of application Ser. No. 08/799,979, filed Feb. 12, 1997, and entitled POWER LIFT BASKETBALL ADJUSTMENT SYSTEM, now issued as U.S. Pat. No. 5,695,417. The foregoing applications and patents are incorporated herein by reference.

BACKGROUND OF THE INVENTION

1. The Field of the Invention

The present invention is related to an apparatus and method for adjusting the height of a basketball goal assembly and, more particularly, to a novel basketball adjustment system having a slider that moves along the support pole. The slider may comprise an adjustment collar that can be unlocked and moved along the support pole with the aid of a trigger to facilitate convenient positioning of a basketball goal in relation to a playing surface.

2. The Relevant Technology

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, it is not surprising that more and more people are mounting basketball goals on their property.

The problem with many basketball goals is that the goal is usually fixed at a certain height above the playing surface. That height is generally the standard basketball goal height often (10) feet. Younger children, however, simply don't have the strength to make a basket at the general standard height of ten feet. Many children, accordingly, may develop improper shooting skills in order to throw a basketball toward a goal that is too high. Oftentimes, children get frustrated with the sport and give it up. Other people may want to experience the feeling of dunking a basketball but are too short to do so. To this end, fixed-height basketball goals make such an experience impossible for many people.

Many attempts have been made to design a basketball goal which is adjustable to several different heights. Adjustable basketball goals allow people of all ages and sizes to enjoy the sport by adjusting the basketball goal to a height above the playing surface that is convenient for them. Some of these basketball goals employ a deformable parallelogramic linkage design that connects the basketball backboard to a rigid support such as a pole. In operation, these prior art deformable parallelogramic linkages are generally lockable to secure the basketball goal at a predetermined height above the playing surface.

One disadvantage of prior art adjustable basketball goal assemblies is that the locking mechanism or adjustment is positioned within or near the parallelogramic linkage, which is commonly located well above the playing surface. When a user desires to adjust the height of the basketball goal, the user is typically required to use a ladder, stool or the like to reach the adjustment mechanism and mechanically "unlock" the basketball goal. As appreciated, this creates the potential danger of the user falling.

Other types of adjustable basketball goals have adjustment systems that are accessible with the use of a rod or pole such as, for example, a broomstick handle. Oftentimes, there is no such adjustment device readily available. The user must therefore suffer the inconvenience of finding a suitable implement, or simply choose not to adjust the height of the basketball goal.

Another disadvantage of many prior art adjustable basketball goal assemblies is that the adjustment mechanism has a locking member which is separate and distinct from the adjustment mechanism. Accordingly, two hands are needed to simultaneously unlock the lock, adjust the adjustment mechanism and then lock the locking member in a predetermined position. In addition, many adjustable basketball goal assemblies comprise prior art locking and adjustment mechanisms that are complex in design, requiring a large number of working components in order to simultaneously and easily adjust and lock the basketball goal system in one of its plurality of configurations. As appreciated, this type of design increases the cost and complexity of manufacturing the basketball goal assembly.

Yet further, many known adjustable basketball goal assemblies can be locked in place at an infinite number of positions. Hence, standard goal heights, such as eight, nine, or ten feet, may be difficult to obtain with accuracy. The user is forced to measure the goal height with every adjustment, or use potentially inaccurate reference markings on the goal assembly to guess the probable height of the basketball goal.

From the foregoing, it will be appreciated that it would be an advancement in the art to provide an adjustable basketball goal assembly that can be adjusted by a user standing at ground level without the use of a ladder or a pole. It would be a further advancement to provide such an adjustable basketball goal assembly that could be adjusted quickly and easily using a single hand of a user. It would be another advancement in the art to provide such an adjustable basketball goal assembly that is simple in design, cost effective to manufacture and transport, and easy to assemble. Additionally, it would be an advancement in the art to provide such an adjustable basketball goal assembly in which the height of the goal could only be locked in place at a plurality of discrete and predictable heights.

BRIEF SUMMARY OF THE INVENTION

The apparatus of the present invention has been developed in response to the present state of the art, and in particular, in response to the problems and needs in the art that have not yet been fully resolved by currently available basketball goals. Thus, it is an overall objective of the present invention to provide a basketball goal that overcomes many or all of the shortcomings in the art discussed above.

To achieve the foregoing object, and in accordance with the invention as embodied and broadly described herein in the presently preferred embodiment, a novel adjustable basketball goal assembly is provided. The basketball goal assembly of the present invention includes a support pole which extends in a substantially upward direction. The support pole has a goal side and a back side opposite the goal side.

A deformable goal support structure is preferably pivotally attached to the goal side of the support pole such that the goal support structure is suspended above the playing surface. A basketball goal is preferably attached to the goal support structure adjacent the goal side of the support pole. In one presently preferred embodiment, the basketball goal includes a rim, a backboard and a net. The goal support structure is configured such that, as the goal support structure deforms, the height of the basketball goal above the playing surface changes, each height corresponding to a different deformation. Specifically, the configuration of the goal support structure allows the rim of the basketball goal to be adjusted to several different heights while remaining horizontally disposed in relation to the playing surface.

A slider, such as an adjustment collar, may be slidably disposed on the support pole. The adjustment collar may have a housing, a trigger, and a resilient member positioned to urge the trigger toward the support pole. A collar engagement feature, such as an extension, may be attached to the trigger proximate the support pole. The support pole may, in turn, have an array of pole engagement features, such as holes configured to form slots or other shapes, or similar structures disposed along a portion of the length of the pole, facing the extension. The extension may engage one of the holes to keep the adjustment collar in place at a selected location along the support pole.

A coupling member is preferably disposed between the goal support structure and the adjustment collar. The coupling member may take the form of an adjustment arm with a first end and a second end. Preferably, the first end of the adjustment arm is attached to the goal support structure, such that the remainder of the adjustment arm extends downward along the back side of the support pole. The second end may be pivotally attached to the housing or trigger of the adjustment collar.

With such a configuration, a user can simultaneously compress the trigger and adjust the position of the adjustment collar along the support pole with a single hand. In operation, downward motion of the adjustment collar draws a leveraging arm on the lower linkage arm down toward the playing surface, causing the basketball goal to rise. Conversely, moving the adjustment collar upward causes the leveraging arm on the lower linkage arm to rise, lowering the basketball goal.

Thus, it is an advantage of the present invention to provide a basketball goal assembly that permits one-handed height adjustment. The basketball goal assembly is conveniently adjustable, cost effective to manufacture, and easy to assemble. It is another advantage of the present invention that the height of the basketball goal is adjustable without the aid of a ladder or pole. It is a further advantage of the present invention that the adjustment collar can be unlocked and the height simultaneously adjusted with the use of a single hand. It is also an advantage of the present invention that the adjustment collar is self-locking, so that releasing the adjustment collar only permits limited motion of the basketball goal. The basketball goal is moved in discreet, predictable increments. The result is safer and more convenient adjustment of the height of the basketball goal.

These and other objects, features and advantages of the present invention will become more fully apparent from the following description and appended claims, or may be learned by the practice of the invention as set forth hereinafter.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 2:
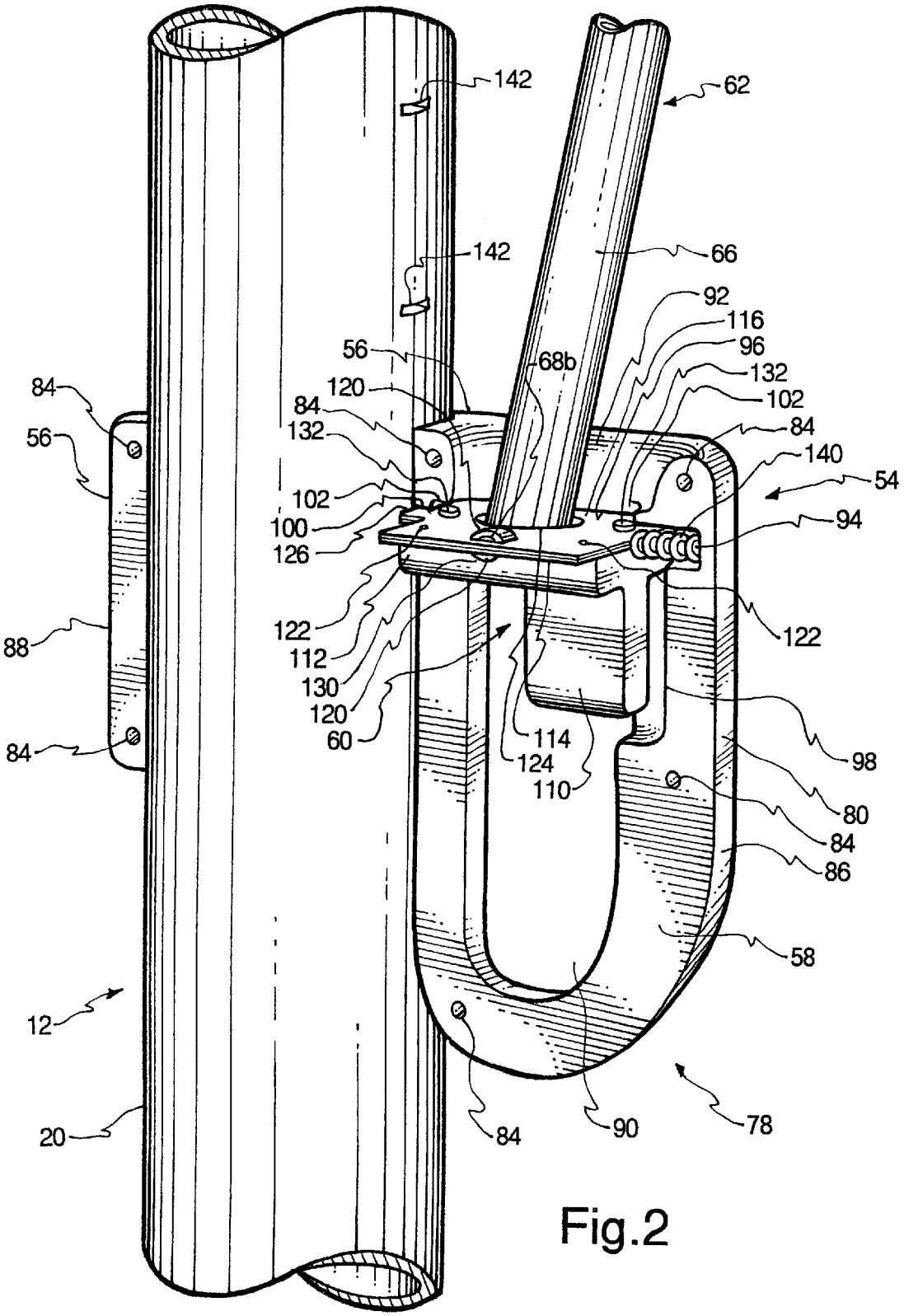
FIG. 2 is a perspective view the adjustment collar of the embodiment of FIG. 1 in partially assembled form, positioned to partially encircle the support pole.
Figure 3:
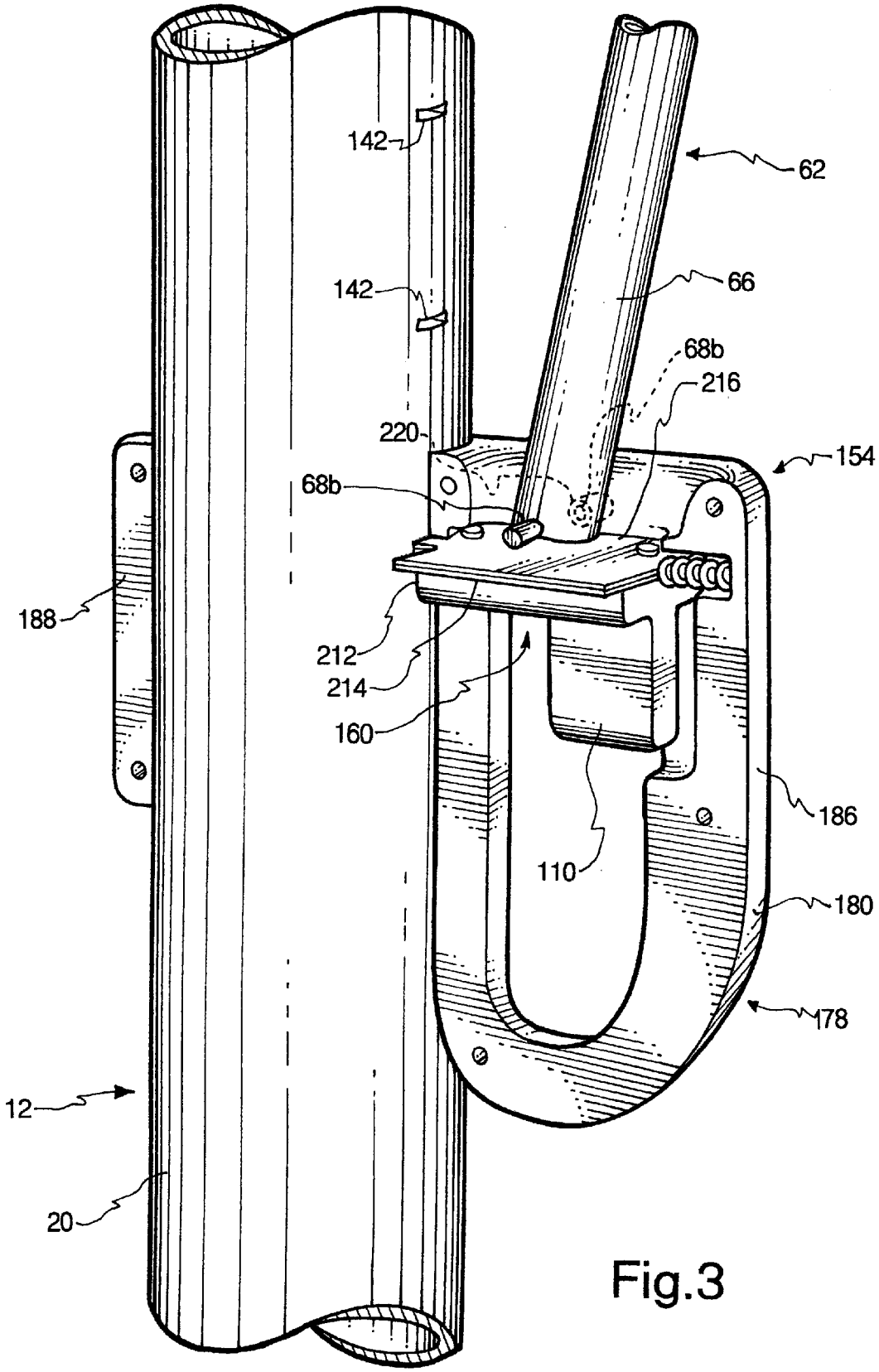
FIG. 3 is a perspective view of an alternative embodiment of an adjustment collar according to the invention, in partially assembled form and positioned to partially encircle the support pole.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 3, is not intended to limit the scope of the invention, as claimed, but it is merely representative of the presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "rigidly attached to" refers to mechanical coupling that comparatively tightly restricts relative translation or rotation between the attached objects, to the extent that relative motion beyond that associated with operational vibration is substantially unable to occur. The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together.

Figure 1:
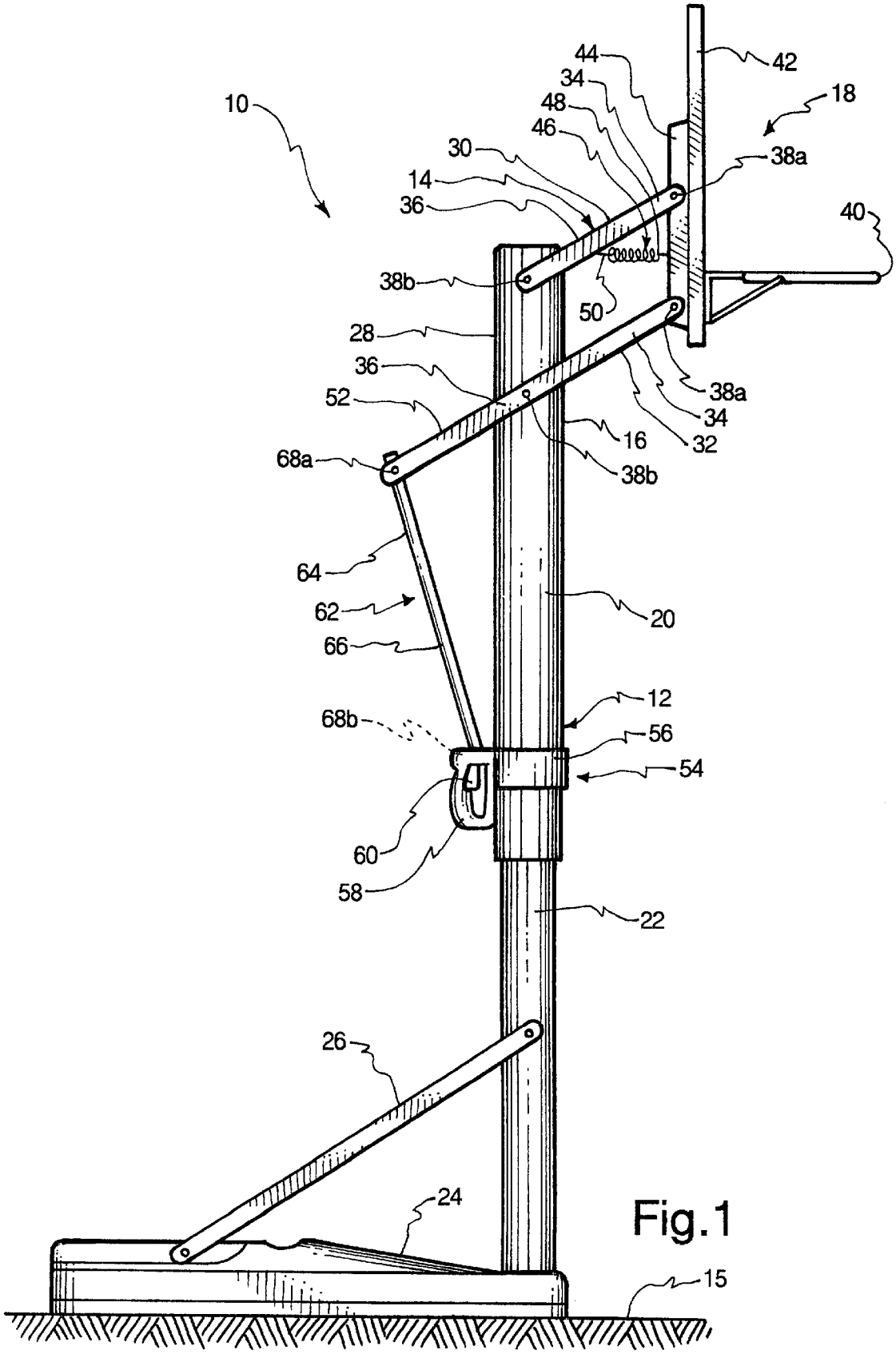
FIG. 1 is a side plan view illustrating a presently preferred embodiment of a height adjustment mechanism for a basketball goal assembly of the present invention.

With reference now to FIG. 1, one presently preferred embodiment of the adjustable basketball goal assembly according to the present invention is generally designated at 10. As shown, the adjustable basketball goal assembly 10 includes a support pole 12 extending in a substantially upward direction in relation to a playing surface 15. A goal support structure 14 is disposed in relation to the support pole 12 adjacent a goal side 16 of the support pole 12. A basketball goal 18 is attached to the goal support structure 14 opposite the support pole 12. In the depicted embodiment, the goal support structure 14 is parallelogramic in shape and is deformable into a plurality of configurations. At each configuration, the basketball goal 18 is disposed at a different height above the playing surface 15.

As used in this application, the term "deformable" refers to the existence of a plurality of configurations, not just locations. The goal support structure 14 does not simply move along the support pole 12; instead, the goal support structure 14 changes in shape. Hence, an object that is movable is not necessarily deformable.

In one presently preferred embodiment, the support pole 12 includes an upper pole section 20 to which the goal support structure 14 is attached, and a lower pole section 22 that is engageably disposed in relation to the upper pole section 20. For example, the lower pole section 22 may be press fit into the upper pole section 20. This configuration may be utilized to make the system 10 easier and more cost effective to package and for storage.

As shown, the lower pole section 22 may be disposed in relation to a support base 24 having a receiving aperture for receiving and retaining the support pole 12 in a generally upright position. In addition, the support base 24 may comprise an internal cavity sufficient for receiving and selectively retaining a ballast material (e.g., water, sand or the like) to support and stabilize the adjustable basketball goal assembly 10 above the playing surface 15. Similarly, a pair of rods 26 may be incorporated to assist in securing the support pole 12 in relation to the support base 24. As will be readily appreciated by those skilled in the art, there are a variety of other suitable ways to stabilize a support pole or connect a support pole to a base that are intended to be incorporated herein. Preferably, the support pole 12 is attached to the support base 24 in such a manner that the center of gravity of the support base 24 is behind a back side 28 of the support pole 12.

The goal support structure 14 of the adjustable basketball goal assembly 10 comprises an upper linkage arm 30 and a lower linkage arm 32. The upper and lower linkage arms 30, 32 each have a proximal end 34 and a distal end 36. In one presently preferred embodiment, the proximal ends 34 of the upper and lower supports 30, 32 are pivotally attached to a backing plate 44. The backing plate 44 is preferably disposed at the rear of a backboard 42 of the basketball goal 18. The basketball goal 18 is also shown with a rim 40 extending longitudinally outward from the front of the backboard 42 in a generally perpendicular configuration.

The proximal ends 34 of the upper and lower linkage arms 30, 32 are shown pivotally attached to the basketball goal 18 by fasteners 38*a* (e.g., bolts, screws, rivets or the like) positioned through openings formed within the backing plate 44. The distal ends 36 of the upper and lower linkage arms 30, 32 are shown pivotally attached to the support pole 12 by fasteners 38*b* (e.g., bolts, screws, rivets or the like) positioned through openings in the support pole 12. It will be appreciated that a variety of fasteners or fastening methods are known in the art to pivotally attach a basketball goal to a support pole 12 and any suitable fastening apparatus or manner may be used.

The upper linkage arm 30, lower linkage arm 32, support pole 12 and the backing plate 44 define the goal support structure 14. As discussed, the goal support structure 14 is preferably parallelogramic in configuration. Because the upper linkage arm 30 and the lower linkage arm 32 are pivotally mounted at each end 34, 36, the parallelogramic goal support structure 14 can be deformed to reposition the height of the basketball goal 18 while allowing the backboard 42 to remain generally vertically disposed and the rim 40 to remain horizontally disposed at all times.

The adjustable basketball goal assembly 10 may optionally be counterbalanced with a resistive member 46 disposed in relation to the goal support structure 14. The resistive member may provide a force that substantially counterbalances the gravitational force acting on the adjustable basketball goal assembly 10 by virtue of the weight of the basketball goal 18. In one presently preferred embodiment, the resistive member 46 comprises a coil spring of sufficient rigidity and stiffness to resist the weight of the basketball goal 18. Preferably, the resistive member 46 has a proximal end 48 attached to the backing plate 44 and a distal end 50 attached to the upper linkage arm 30 of the goal support structure 14. The counterbalancing provided by the resistive member 46 allows for adjustment of the height of the basketball goal 18 above the playing surface 15 with minimal effort.

It will be appreciated that many different methods could be employed to counter-balance the adjustable basketball goal assembly 10. For example, linear springs, angular springs, leaf springs, hydraulic, pneumatic, or hybrid pistons, or the like could be attached between some combination of the upper linkage arm 30, the lower linkage arm 32, the support pole 12, and the backing plate 44.

In one presently preferred embodiment, at least one of the linkage arms 30, 32 includes a leveraging arm 52 which extends beyond the distal end 36 thereof and substantially outward from the back side 28 of the support pole 12. In one preferred design, the leveraging arm 52 is an integral part of the lower linkage arm 32. The leveraging arm 52 provides a leveraged point from which to adjust the height of the basketball goal 18. In operation, exerting a downward force on the leveraging arm 52 deforms the goal support structure 14 in such a manner as to raise the basketball goal 18 in relation to the playing surface. Whereby, allowing the leveraging arm 52 to rise upward, deforms the goal support structure 14 in a manner which lowers the basketball goal 18 in relation to the playing surface.

A slider 54 is coupled to slide along a longitudinal axis of the support pole 12. The longitudinal axis is simply the axis that extends along the length of the support pole 12. The support pole 12 of FIG. 1 is substantially vertical; hence, the longitudinal axis of FIG. 1 is also substantially vertical. However, the present invention also has application to basketball goal assemblies in which the support pole does not have a vertical longitudinal axis. For example, the support pole 12 may be disposed at a non-perpendicular angle with respect to the playing surface 15. The slider 54 would then move along a non-vertical longitudinal axis. The slider 54 may comprise any device that is coupled directly or indirectly to the support pole 12 in such a manner that the slider 54 only moves significantly along the longitudinal axis.

As shown, the slider 54 may take the form of an adjustment collar 54 slidably attached to the support pole 12. More specifically, the adjustment collar 54 may have a tubular portion 56 that generally encircles the support pole 12 and a handle 58 designed to be easily grasped and moved upward or downward by a user. As shown, the handle 58 is fixed in place with respect to the remainder of the adjustment collar 54. Hence, the handle 58 maintains the same position and orientation with respect to the adjustment collar 54 when the adjustment collar 54 is moved along the support pole 12. Since the adjustment collar 54 cannot rotate with respect to the support pole 12, the handle 58 also maintains the same orientation with respect to the support pole 12, regardless of the position of the adjustment collar 54 along the support pole 12.

In the alternative to the configuration of FIG. 1, the adjustment collar 54 need not directly interface with the support pole 12, but may substantially encircle a strut (not shown) disposed parallel to the support pole 12. Such a strut may simply be affixed to the support pole 12 through the use of welding, fasteners, or the like. The adjustment collar 54 would then move along-the strut, parallel to the longitudinal axis.

If desired, the tubular portion 56 may be replaced by any other structure that keeps the adjustment collar 54 from moving perpendicular to the support pole. A split ring configuration, for example, could be used in the place of the tubular portion 56. Thus, "collar," as used in this application, does not require a structure that fully encircles the support pole 12. Rather, a collar is any device with a shape that prevents significant motion of the collar perpendicular to the support pole 12.

The support pole 12 depicted in FIG. 1 is cylindrical with a solid or hollow shape, and thus has a substantially circular or annular cross section. The adjustment collar 54 may thus include a tubular shape that receives the support pole 12. In other embodiments, it may be advantageous to use a support pole with a rectangular, triangular, or otherwise non-circular cross sectional shape. In such a case, an adjustment collar with a different shape may be used to suit the shape of the support pole. For example, the support pole 12 may have a rectangular, triangular, or otherwise non-circular opening sized to contain the cross section of the support pole.

The adjustment collar 54 may also have a trigger 60 protruding from the handle 58. The trigger 60 may be formed of a lightweight, easily-molded material such as a plastic. Under normal play conditions, the adjustment collar 54 is fixed with respect to the support pole 12. However, when the trigger 60 is depressed, the adjustment collar 54 is able to move along the length of the support pole 12. Motion of the adjustment collar 54 is transferred to the goal support structure 14 through a coupling member 62, which may take the form of an arm, pulley system, cam system, linkage, or any other device that transmits force from the adjustment collar to the goal support structure 14.

Those of skill in the art will recognize that other actuating mechanisms besides the trigger 60 may be used to move the adjustment collar 54 between the engaged and disengaged positions. For example, buttons, levers, knobs, and the like may be used in place of the trigger 60, within the scope of the invention.

As shown, the coupling member takes the form of an adjustment arm 62. If desired, the adjustment arm 62 may also be utilized to provide counterbalancing force for the basketball goal assembly 10. For example, the adjustment arm 62 may be weighted, or may be disposed in parallel with a linear spring, piston assembly, or the like. The goal support structure 14, the adjustment collar 54, and the adjustment arm 62 may, together, be termed an "adjustment assembly." The adjustment assembly may also include other components that facilitate adjustment of the height of the basketball goal 18.

The adjustment arm 62 preferably has a first end 64 pivotally attached to the leveraging arm 52 and a second end 66 pivotally attached to the adjustment collar 54. Fasteners 68*a* and 68*b* of any known type, such as bolts, screws, rivets, or the like, may be used to connect the adjustment arm 62 to the leveraging arm 52 and to the adjustment collar 54, respectively.

Although FIG. 1 depicts the adjustment arm 62 in a position behind the support pole 12, those of skill in the art will recognize that other configurations are possible. For example, the first end 64 of the extension am 62 need not be connected to the leveraging arm 52, but may instead be pivotally connected to the upper linkage arm 30 or the lower linkage arm 32, between the fasteners 38*a* and the fasteners 38*b*. The handle 58 of the adjustment collar 54 may also be disposed on the front side 16 of the support pole 12. Positioning on the back side 28 may, however, more effectively keep the handle member 58 clear of game play.

FIG. 2 shows the adjustment collar 54, in a partially assembled state, in engagement with the support pole 12. The adjustment collar 54 may have a housing 78 formed in two substantially symmetrical halves. The housing 78 may be formed of a lightweight, inexpensive material such as a plastic. Alternatively, the housing 78 may be constructed of a high strength material such as steel or aluminum. The tubular portion 56 and the handle 58 may be integrally formed as part of the housing 78. In the alternative, the handle 58 may be formed separately and affixed to the tubular portion 56, for example, through the use of fasteners, welding, or adhesives.

A first half 80 of the housing 78 is depicted in FIG. 2. The first half 80 may have a plurality of attachment holes 84 to permit attachment of a second half (not shown) to the first half 80. For example, the second half may have holes aligned with the holes 84 of the first half, so that bolts, screws, rivets, or the like may be used to attach the second half to the first half 80. Alternatively, the second half may have flexible protuberances positioned to fit into the holes 84 to lock the second half and the first half 80 together.

The housing 78 may have a back end 86 and a front end 88 that correspond to the back side 28 and front side 16 of the support pole 12, respectively. The first half 80 and the second half may have a number of features designed to accommodate the trigger 60 and other parts necessary to the operation of the adjustment collar 54. More specifically, the first half 80 may have an opening 90 shaped to accommodate the fingers of a person gripping the handle 58. The first half 80 may also have a port 92 on the top of the handle 58, through which the second end 66 of the adjustment arm 62 may extend for attachment.

A first cavity 94 may be formed by aligned recesses on the inside surfaces of the first half 80 and the second half of the housing 78. The first cavity 94 may be horizontally elongated, and may be positioned toward the back end 86 of the housing 78. A second cavity 96 may similarly be formed, and may be somewhat wider laterally than the first cavity 94. A third cavity 98 may have be somewhat higher, but also shallow, with a position generally in back of the trigger 60.

The first half 80 and the second half of the housing 78 may also cooperate to form a slot 100 adjacent to the pole, through which the trigger 60 can induce locking of the adjustment collar 54 at a desired position along the length of the support pole 12. Additionally, detente surfaces 102 may face downward toward the trigger 60 to keep the trigger 60 within the housing 78.

The trigger 60 may have a finger extension 110 and a block 112. The finger extension 110 may protrude from the housing 78 and into the opening 90. A user gripping the handle 58 can exert pressure to press the finger extension 110 rearward, into the third cavity 98. The finger extension 110 may be attached to or integrally formed with the block 112 with a generally rectangular shape. The block 112 may rest within the second cavity 96, which is preferably long enough to accommodate motion of the block 112 toward and away from the support pole 12.

One or more plates, such as the lower plate 114 and upper plate 116 depicted in FIG. 2, may be affixed atop the block 112. Preferably, the plates are constructed of a metal such as steel or aluminum. Each of the plates 114, 116 preferably has a pair of bridge portions 120 that form a pair of cylindrical cavities on either side of the second end 66 of the adjustment arm 62 to receive the fastener 68*b*. In this embodiment, the fastener 68*b* takes the form of a shaft 68*b* protruding from both sides of the second end 66 of the adjustment arm 62. The shaft 68*b* may be integrally formed with the adjustment arm 62, or may be inserted within a hole (not shown) formed in the second end 66 of the adjustment arm 62.

The plates 114, 116 may also have attachment holes 122 by which the plates 114, 116 can be affixed to the block 112. The plates 114, 116 may also have an opening 124 large enough to receive the second end 66 of the adjustment arm 62 and permit a small amount of relative pivotal motion between the adjustment arm 62 and the trigger 60. Each of the plates 114, 116 also preferably has a slider engagement feature 126, or collar engagement feature 126, that facilitates engagement of the adjustment collar 54 with the support pole 12. The collar engagement features 126 may be configured to mate with any of a plurality of corresponding engagement features on the support pole 12. Each of the collar engagement features 126 may thus be an extension, opening, or any other feature that can be mated with another feature.

As shown, each collar engagement feature 126 comprises an extension 126 positioned within the slot 100. The extensions 126 of the plates 114, 116 abut each other and therefore operate as a single unit. Of course, both of the plates 114, 116 need not have an extension 126; an extension on one of the plates 114, 116 may be sufficient to prevent motion of the adjustment collar 54 along the support pole 12 when desired. The use of extensions 126 on both of the plates 114,116 simply provides additional material to keep the extensions 126 from being sheared off during game play.

The extensions 126 may be configured as rectangular extensions 126. The term "extension" simply refers to any type of protruding shape; hence, the extension 126 need not be rectangular, but may have any rounded or flat-sided shape including a circle, polygon, I-shape, or the like. If a non-rectangular extension 126 is used, the slot 100 may be replaced with a hole that has the corresponding shape. For example, a circular, polygonal, or I-shaped hole may be used.

If the collar engagement feature 126 were to comprise a hole (not shown) designed to mate with a series of extensions (not shown) on the support pole 12, the collar engagement feature 126 may include a plate (not shown) that generally faces the support pole 12. The hole may then be formed in the plate, and the plate may be coupled to the trigger 60 so that the plate and hole are able to move toward or away from the support pole 12 to engage or disengage the extensions. Such an embodiment may operate in substantially the same manner as the embodiment of FIG. 2.

Returning to FIG. 2, the block 112 may have a cavity (not shown) aligned with the openings 124 to receive the second end 66 of the adjustment arm 62 and permit some pivotal motion of the second end 66 in relation to the block 112. The block 112 may also have two arcuate recesses 130 to receive the bridge portions 120 of the lower plate 114. The block 112 may also have threaded holes (not shown) with the attachment holes 122 of the plates 114, 116. Fasteners 132 may be inserted into the attachment holes 122 and threadably engaged in the block 112. Preferably, the fasteners 132 take the form of short screws 132. Heads of the fasteners 132 may then protrude above the upper plate 116 to abut the detente surfaces 102. When the trigger 60 moves toward or away from the support pole 12, the fasteners 132 then slide along the detente surfaces 102.

Preferably, a resilient member 140 rests within the first cavity 94. The resilient member 140 may take any form suitable for urging the trigger 60 toward the support pole 12. Linear springs, angular springs, leaf springs, hydraulic, pneumatic, or hybrid pistons are examples of devices that can be used for the resilient member. In the alternative, no resilient member 140 need be provided; the user may simply manually actuate the adjustment collar 54 from the disengaged position to the engaged position. In the embodiment of FIG. 2, the resilient member 140 is configured as a helical, linear spring 140 abutting the trigger 60.

The support pole 12 may have a plurality of pole engagement features 142, or features designed to facilitate engagement of the support pole 12 with the adjustment collar 54. Like the collar engagement features 126, the pole engagement features 142 may be configured in a wide variety of ways, including extensions, holes, and the like. In the embodiment shown, the collar engagement features 126 comprise extensions 126. Hence, the pole engagement features 142 may comprise holes 142, arrayed along a portion of the length of the support pole 12.

The holes 142 may be configured as slots 142 in order to receive the rectangular extensions 126 with a small amount of clearance. If the extensions 126 were to have a cylindrical or other non-rectangular shape, the holes 142 in the support pole 12 may be altered in shape accordingly. Similarly, if the collar engagement features 126 were to be configured as one or more holes (not shown), in place of the extensions 126 depicted in FIG. 2, the pole engagement features 142 may then comprise a series of extensions (not shown) sized to mate with the holes of the collar engagement features. The present invention encompasses the use of any combination of mating engagement features.

When the rectangular extensions 126 are outside the slots 142, as when the adjustment collar 54 is positioned so that the rectangular extensions 126 are not aligned with one of the slots 142, the resilient member 140 is deflected. In the case of the linear spring 140, "deflection" means compression of the linear spring 140 so that the linear spring 140 exerts a greater force tending to urge the trigger 60 toward the support pole 12. This condition of the resilient member 140 may be referred to as a more deflected state. Conversely, when the rectangular extensions 126 are seated within one of the slots 142, the resilient member 140 is in a less deflected state. The less deflected state may even entail complete relaxation of the resilient member 140, so that the resilient member 140 provides no force against the trigger 60.

Thus, when the trigger 60 is positioned so that the rectangular extensions 126 are engaged within one of the slots 142, the adjustment collar 54 is in the engaged position, i.e., the position in which the position of the adjustment collar 54 is locked with respect to the support pole 12. Conversely, when the rectangular extensions 126 are not engaged within one of the slots 142, the adjustment collar 54 is in the unlocked position, in which the adjustment collar 54 is able to slide along the support pole 12.

If the resilient member 140 is present, the user may easily adjust the height of the basketball goal 18 with a single hand. A user must simply grasp the handle 58 of the adjustment collar 54 and compress the finger extension 110 into the housing 78. The resilient member 140 is compressed, and the rectangular extensions 126 are withdrawn from the slot 142 in which they were engaged. The user may then exert force upward or downward against the handle 58 to move the adjustment collar 54 vertically toward another of the slots 142.

If the user wishes to move the adjustment collar 54 to an adjacent slot 142, the user may release the finger extension 110 as soon as the rectangular extension 126 is no longer aligned with the slot from which it was withdrawn. The rectangular extension 126 will simply slide along the back side 28 of the support pole 12, between the slots 142, until it reaches the adjacent slot 142, at which point it will be forced into the slot 142 by the resilient member 140. If a user wishes to move the adjustment collar 54 a greater distance, the user may maintain a grip on the finger extension 110 to restrain the rectangular extension 126 until the rectangular extension 126 is positioned over the desired slot 142.

In this manner, adjustment of the basketball goal assembly 10 may be accomplished through the use of only a single hand. Only a single motion is required because the trigger 60 is propelled by the resilient member 140 to return the adjustment collar 54 to a fixed state. A user thus need not move any lever, knob, or other actuator to stop the motion of the basketball goal 18. In addition to the added convenience, such operation provides added safety because the basketball goal 18 can only move a limited distance when a user is not gripping the handle 58. Consequently, if the adjustment collar 54 is released and left unattended, the goal 18 cannot swing through a large arc to strike or pinch a user.

Many of these benefits are obtained through the use of the resilient member 140; if the resilient member 140 were omitted, the user may be required to manually move the adjustment collar 54 back to the engaged position to prevent further motion of the basketball goal 18. In the event that the resilient member 140 is not present, other devices maybe used to facilitate re-engagement of the adjustment collar 54. For example, the trigger 60 may have a finger ring or other similar structure that permits the user to push the trigger 60 back toward the support pole 12, thereby moving the adjustment collar 54 back to the engaged position.

Due to the manner in which the extensions 126 engage the slots 142, the basketball goal assembly 10 is adjustable to a plurality of discreet positions. Hence, the user can consistently adjust the basketball goal assembly 10 to a plurality of desirable heights, such as eight feet, nine feet, and ten feet, and selected heights in between.

Referring to FIG. 3, a differently-configured adjustment collar 154 is depicted. Rather than connecting the second end 66 of the adjustment arm 62 to the trigger 160, as in FIG. 2, the second end 66 may be pivotally connected to the housing 178 of the adjustment collar 154.

As with the embodiment shown in FIG. 2, the housing 178 of the adjustment collar 154 may have a first half 180 and a second half (not shown) substantially symmetrical to the first half 180. The housing 178 may also have a back end 186 and a front end 188. The trigger 160 may have a block 212 similar to the block 112, but without the arcuate recesses 130 or the cavity of the block 112. Similarly, the trigger 160 of FIG. 3 may have lower and upper plates 214 and 216. The plates 214, 216 need not have bridge portions 120 or openings 124 to accommodate the second end 66 of the adjustment arm 62. Since the plates 214, 216 do not retain the shaft **68*b***, they may be combined with a single plate, if desired.

The first half 180 of the housing 178 may have a hole 220 positioned within the port 92 to receive the shaft **68*b*. The second half may have a similar hole (not shown) so that the shaft 68*b* is rotatably held on both sides. Bushings or other protective members may be installed within the hole 220 of the first half 180 and that of the second half, particularly if the housing 178** is constructed of a comparatively soft material such as a polymer.

Operation of the adjustment collar 154 may otherwise be similar to the operation of the adjustment collar 54 described earlier. The alternative form of attachment of the second end 66 of the adjustment arm 62 may provide a number of advantages. For example, the trigger 160 is independent of the adjustment arm 62, and may thus be easier to move toward or away from the support pole 12. The resilient member 140 may thus have a somewhat lower spring constant. As a result, the adjustment collar 154 may also be easier to move between engaged and disengaged positions. Additionally, the configuration of FIG. 3 may provide manufacturing or assembly advantages.

By the present invention, a basketball goal assembly is provided that permits easy adjustment of the height of the basketball goal. A user may simply and accurately adjust the height to a number of discreet levels. Only one hand is required. Additionally, the basketball goal system of the present invention is safer than many known alternative designs because the basketball goal is only able to travel for a limited distance when unattended by a user.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A basketball goal assembly allowing for adjustment of a height of a basketball goal above a playing surface, the basketball goal assembly comprising:

a support pole;

a goal support structure interposed between the support pole and the basketball goal, wherein the goal support structure is deformable into a plurality of configurations, wherein at each configuration the basketball goal is disposed at a different height with respect to the support pole; and a slider having a trigger movable by a user to enable translation of the slider along a longitudinal axis of the support pole, wherein the slider is coupled to the goal support structure such that motion of the slider along the support pole induces deformation of the goal support structure.

2. The adjustable basketball goal assembly of claim 1, wherein the goal support structure is substantially parallelogramic in configuration.

3. The adjustable basketball goal assembly of claim 2, wherein the goal support structure comprises an upper linkage arm and a lower linkage arm, at least one of the linkage arms having a leveraging arm that protrudes in a direction generally away from the support pole.

4. The adjustable basketball goal assembly of claim 3, further comprising an adjustment arm having a first end pivotally attached to the leveraging arm and a second end pivotally attached to the slider such that motion or the slider along the support pole exerts force on the adjustment arm to induce deformation of the deformable goal support structure.

5. The adjustable basketball goal assembly of claim 1, wherein the support pole further comprises a plurality of holes arrayed parallel to a longitudinal axis of the pole.

6. The adjustable basketball goal assembly of claim 5, wherein the slider comprises an adjustment collar that substantially encircles the support pole.

7. The adjustable basketball goal assembly of claim 6, wherein the adjustment collar further comprises:

a housing;

a resilient member retained by the housing and coupled to the trigger such that pressure exerted on the trigger urges the resilient member toward a more deflected state; and an extension urged toward engagement with the holes by the resilient member.

8. The adjustable basketball goal assembly of claim 7, wherein the extension is rigidly attached to the trigger.

9. The adjustable basketball goal assembly of claim 7, wherein the second end of the adjustment arm is pivotally attached to the housing of the adjustment collar.

10. The adjustable basketball goal assembly of claim 7, wherein the second end or the adjustment arm is pivotally attached to the trigger of the adjustment collar.

11. The adjustable basketball goal assembly of claim 1, wherein the slider comprises an adjustment collar that substantially encircles a strut disposed substantially parallel to the support pole.

12. A basketball goal assembly comprising:

a support pole;

a basketball goal supported by the support pole; and a slider coupled to the basketball goal such that a height of the basketball goal above a playing surface varies according to a position of the slider along the support pole, wherein the slider has an engaged position in which the slider is substantially fixed with respect to the support pole and a disengaged position in which the slider is able to translate along a longitudinal axis of the support pole, wherein the slider is biased into the engaged position, the slider having a handle disposed at a fixed orientation with respect to the support pole.

13. The basketball goal assembly of claim 12, further comprising a goal support structure interposed between the support pole and the basketball goal, wherein the goal support structure is deformable into a plurality of configurations, wherein at each configuration the basketball goal is disposed at a different height with respect to the support pole.

14. The basketball goal assembly of claim 13, further comprising an adjustment arm having a first end pivotally attached to the goal support structure and a second end pivotally, attached to the slider such that motion of the slider along the support pole exerts force on the adjustment arm to induce deformation of the deformable goal support structure.

15. The basketball goal assembly of claim 12, wherein the support pole comprises a plurality of pole engagement features distributed along a longitudinal axis of the support pole, and wherein the slider further comprises a slider engagement feature selectively engageable with each of the pole engagement features to move the slider into the engaged position.

16. The basketball goal assembly of claim 15, wherein each of the pole engagement features comprises a hole, and wherein the slider engagement feature comprises an extension shaped to be inserted into each of the holes to move the slider into the engaged position.

17. The basketball goal assembly of claim 15, wherein each of the pole engagement features comprises an extension, and wherein the slider engagement feature comprises a hole shaped to receive each of the extensions.

18. The basketball goal assembly of claim 12, wherein the slider comprises an adjustment collar that substantially encircles the support pole.

19. The adjustable basketball goal assembly of claim 18, wherein the adjustment collar further comprises:

a housing;

a resilient member retained by the housing; and a trigger configured to receive pressure from a user to move the slider from the engaged position to the disengaged position, wherein the trigger is coupled to the resilient member such that pressure exerted on the trigger urges the resilient member toward the more deflected state.

20. The adjustable basketball goal assembly of claim 19, wherein the resilient member comprises a linear spring positioned to compress when the trigger receives pressure from a user.

21. An adjustment assembly for adjusting a height of a basketball goal with respect to a support pole supporting the basketball goal, the adjustment assembly comprising:

a goal support structure interposed between a support pole and the basketball goal, wherein the goal support structure is deformable into a plurality of configurations, wherein at each configuration the basketball goal is disposed at a different height with respect to the support pole;

an adjustment collar substantially encircling the support pole, wherein the adjustment collar is disposable at a plurality of discrete positions along a longitudinal axis of the support pole, the adjustment collar having a handle disposed at a fixed orientation with respect to the support pole; and a coupling member disposable to couple the adjustment collar to the goal support structure such that each of the discrete positions corresponds to a different configuration of the goal support structure.

22. The adjustment assembly of claim 21, wherein the goal support structure is substantially parallelogramic in configuration.

23. The adjustment assembly of claim 21, wherein the adjustment collar further comprises an extension shaped to be insertable into each of a plurality of holes arrayed parallel to a longitudinal axis of the support pole.

24. The adjustment assembly of claim 23, wherein the adjustment collar further comprises a trigger coupled to the extension to withdraw the extension from the holes in response to actuation of the trigger by a user.

25. The adjustment assembly of claim 24, wherein the adjustment collar further comprises a resilient member coupled to the extension to urge the extension toward the holes, the resilient member comprising a linear spring positioned to be compressed when the trigger is actuated by a user.

26. The adjustment assembly of claim 23, wherein the coupling member comprises an adjustment arm pivotally attached to the goal support structure and to the extension.

27. The adjustment assembly of claim 23, wherein the adjustment collar further comprises a housing constructed of a plastic material, wherein the handle is integrally formed with the housing.

28. The adjustment assembly of claim 27, wherein the coupling member comprises an adjustment arm pivotally attached to the goal support structure and to the housing.

29. A method for manufacturing a basketball goal assembly allowing for adjustment of a height of a basketball goal above a playing surface, the method comprising:

forming a support pole capable of supporting the goal above a playing surface;

distributing a plurality of pole engagement features along a longitudinal axis of the support pole;

forming a housing for an adjustment collar, the housing having a shape selected to substantially encircle the support pole, the housing further having a shape selected to receive a resilient member, the housing having a handle integrally formed therein; and forming a collar engagement feature capable of receiving biasing force from the resilient member such that the collar engagement feature is urged into engagement with one of the pole engagement features to fix a position of the housing with respect to the support pole.

30. The method of claim 29, wherein fanning the housing comprises shaping a plastic material through a process selected from the group consisting of injection molding and blow molding.

31. The method of claim 29, further comprising installing the collar engagement feature in the housing such that the collar engagement feature is translatable with respect to the housing.

32. The method of claim 31, further comprising installing the resilient member such that the resilient member is compressed by the housing and the collar engagement feature.

33. The method of claim 32, further comprising coupling a trigger to the collar engagement feature such that compression of the trigger and the housing urges the collar engagement feature away from the pole engagement features.

34. A method for adjusting a basketball goal assembly, the basketball goal assembly comprising a basketball goal, a support pole supporting the basketball goal, a slider selectively slidable along the support pole to induce vertical motion or the basketball goal, the slider having a resilient member configured to restrain sliding of the slider in a less deflected state of the resilient member and to permit sliding of the slider in a more deflected state of the resilient member, the slider further having a trigger positioned to deflect the resilient member when the trigger is actuated by a user, the method comprising the steps of:

actuating the trigger to deflect the resilient member to the more deflected state to release the slider;

translating the slider along a longitudinal axis of the support pole while maintaining the resilient member in the more deflected state to vertically reposition the goal; and releasing the trigger to permit the resilient member to return to the less deflected state to fix the position of the slider with respect to the support pole.

35. The method of claim 34, wherein actuating the trigger comprises pressing the trigger at least partially into the housing.

36. The method of claim 34, wherein actuating the trigger comprises withdrawing a slider engagement feature from one of a plurality of pole engagement features arrayed along the longitudinal axis.

37. The method of claim 36, further comprises aligning the slider engagement feature with another of the pole engagement features such that releasing the trigger comprises permitting the slider engagement feature to engage the pole engagement feature.

38. The method of claim 34, wherein translating the slider comprises grasping a handle of the slider and moving the handle along the longitudinal axis.

* * * * *

UNITED STATES PATENT AND TRADEMARK OFFICE

CERTIFICATE OF CORRECTION

PATENT NO. : 6,645,095 B1
DATED : November 11, 2003
INVENTOR(S) : S. Curtis Nye and David C. Winter It is certified that error appears in the above-identified patent and that said Letters Patent is hereby corrected as shown below:

Title page,
Item [56], OTHER PUBLICATIONS, change “illinois” to -- Illinois --; change “ “Kits”,” to -- “Kits,” --; change “Grounds”,” to -- Grounds,” --; change “Goal”,” to -- Goal,” --; and change “manul” to -- manual --

Column 1,
Line 59, change “(10)” to -- ten --

Column 8,
Line 17, change “am” to -- arm --

Column 9,
Line 51, change “114,116” to -- 114, 116 --

Column 13,
Line 41, change “or” to -- of --

Column 16,
Line 14, change “or” to -- of --

Signed and Sealed this

Sixteenth Day of March, 2004

JON W. DUDAS
*Acting Director of the United States Patent and Trademark Office*